US007856727B2

(12) United States Patent
Chiorean et al.

(10) Patent No.: US 7,856,727 B2
(45) Date of Patent: Dec. 28, 2010

(54) INDEPENDENT POSITION SENSOR AND A SYSTEM TO DETERMINE THE POSITION OF A TOOL ON A WORKS MACHINE USING POSITION SENSORS

(75) Inventors: Dimitru Mircea Chiorean, Le Mesnil le Roi (FR); Gianmarco Bonetti, Castello Sopra Ticino (IT); Albert Gamal, Le Mesnil le Roi (FR)

(73) Assignee: Agatec, Le Mesnil le Roi (FR)

( * ) Notice: Subject to any disclaimer, the term of this patent is extended or adjusted under 35 U.S.C. 154(b) by 129 days.

(21) Appl. No.: 12/255,157

(22) Filed: Oct. 21, 2008

(65) Prior Publication Data

US 2010/0096148 A1 Apr. 22, 2010

(51) Int. Cl.
*G01C 9/02* (2006.01)

(52) U.S. Cl. ..... 33/1 N; 33/366.11; 33/333; 33/371

(58) Field of Classification Search ..... 33/1 N, 33/366.11, 333, 371
See application file for complete search history.

(56) References Cited

U.S. PATENT DOCUMENTS

| | | | | |
|---|---|---|---|---|
| 3,566,386 | A * | 2/1971 | Hamilton | 340/685 |
| 3,865,265 | A * | 2/1975 | Brudi et al. | 414/635 |
| 4,288,196 | A * | 9/1981 | Sutton, II | 414/699 |
| 4,452,078 | A * | 6/1984 | Formanek et al. | 73/865.2 |
| 4,491,927 | A | 1/1985 | Bachmann et al. | |
| 4,590,801 | A * | 5/1986 | Merhav | 73/510 |
| 5,848,485 | A | 12/1998 | Anderson et al. | |
| 6,336,077 | B1 | 1/2002 | Boucher | |
| 6,609,315 | B1 | 8/2003 | Hendron et al. | |
| 7,318,283 | B2 * | 1/2008 | Kurose et al. | 33/366.24 |
| 7,350,304 | B2 * | 4/2008 | Van Luchene | 33/366.11 |
| 7,562,458 | B1 * | 7/2009 | Clark et al. | 33/333 |
| 2003/0093248 | A1 * | 5/2003 | Vock et al. | 702/188 |
| 2005/0017602 | A1 * | 1/2005 | Arms et al. | 310/339 |
| 2006/0085118 | A1 | 4/2006 | Baldwin | |
| 2006/0243180 | A1 | 11/2006 | Sundermeyer et al. | |
| 2007/0044237 | A1 * | 3/2007 | Williams | 5/613 |
| 2008/0058835 | A1 * | 3/2008 | Farritor et al. | 606/130 |
| 2010/0042357 | A1 * | 2/2010 | McCoy et al. | 702/141 |

FOREIGN PATENT DOCUMENTS

| | | |
|---|---|---|
| DE | 4335479 | 5/1994 |
| FR | 2620148 | 3/1989 |
| GB | 2208947 | 4/1989 |

* cited by examiner

*Primary Examiner*—Christopher W Fulton
(74) *Attorney, Agent, or Firm*—Lowe Hauptman Ham & Berner LLP

(57) ABSTRACT

The system is used to determine the position of a tool mounted on a digging machine. It includes a monitoring appliance and several independent position-detecting devices each including a face equipped with attachment elements to be held flush against an articulated component of the machine, a wireless communication module remotely sending data to the monitoring appliance, an independent electrical power supply source, a processing unit, and an electronic module with angular position sensors. The devices are distributed so that each is on a different articulated part of the machine. They need no cables, and are easy to fit. The signals emitted by the devices are received by the monitoring appliance, which calculates a setpoint for positioning the tool.

19 Claims, 3 Drawing Sheets

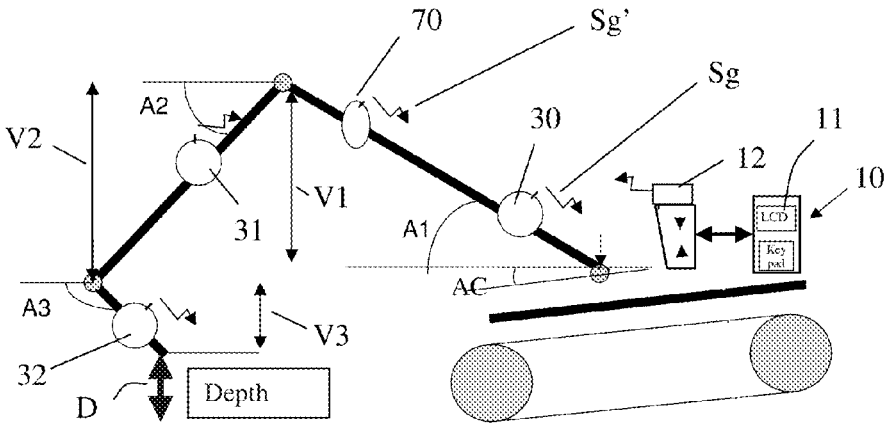
Fig. 3
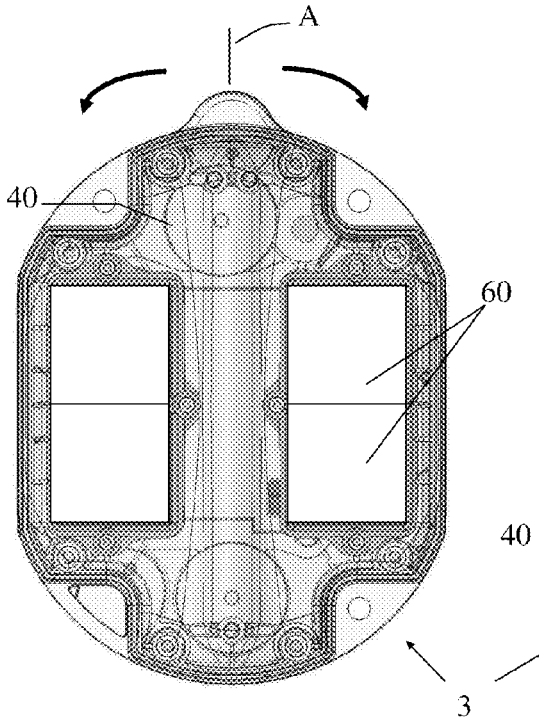
Fig. 4A
Fig. 4B
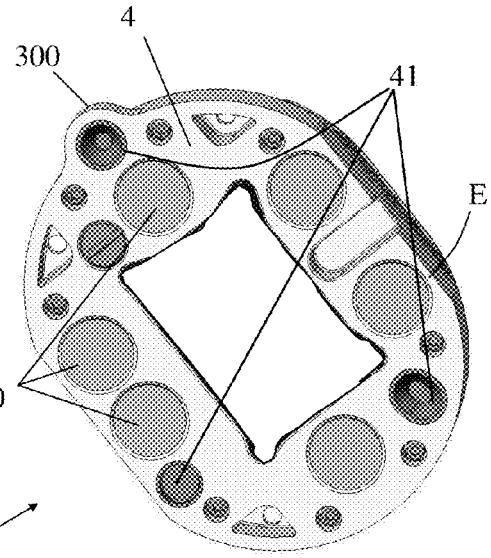

INDEPENDENT POSITION SENSOR AND A SYSTEM TO DETERMINE THE POSITION OF A TOOL ON A WORKS MACHINE USING POSITION SENSORS

TECHNICAL FIELD OF THE INVENTION

This present invention concerns position indicating devices in the field of control relating to excavation tools or similar articulated tools on the arm of a digging machine. The invention more particularly concerns an angular position detecting device, to be fitted to an articulated component of a digging machine, as well as a system for determining the position of a tool mounted on an articulated arm of a digging machine. The invention also concerns an excavation machine in which it is possible to monitor the geometry and the position of the bucket/bucket-arm assembly.

TECHNOLOGICAL BACKGROUND OF THE INVENTION

We are aware, from the prior art, via documents U.S. Pat. No. 4,491,927, U.S. Pat. No. 5,848,485, U.S. Pat. No. 6,336,077, U.S. Pat. No. 6,609,315 and FR 2 620 148 for example, of many systems to control the position of a tool placed at the end of an articulated arm, using inclinometric sensors communicating with a centralised electronic processing unit (generally installed in the control cabin).

We are also aware, via document US 2006/243180, of a system to classify an operation executed by a digging machine. The system can include sensors, cabled or not, positioned on the machine, with each sensor being configured to detect one or more parameters associated with the machine. In addition, the system can include a memory used to store classification data associated with different types of operations that can be executed by the machine. The system can also include a processor that is configured to receive a signal that indicates at least one detected parameter and to classify an operation on a machine in at least one of the different types of operations that can be executed by the machine as a function of the signal received and of the classification data stored.

Document US 2006/085118 also proposes an excavation machine that includes an arm, a bucket, a lift cable by which the bucket is suspended from the arm, and a drawing cable to draw the bucket. The technical means are used to supply data on the alignment, in a vertical plane containing the axis of the arm, of at least one of the components of the machine. These data can be entered via a man-machine interface by which the monitoring stage is effected by an operator, and/or it can be entered via means to monitor the control of the lift cable and/or of the drawing cable so as to reduce or stop the said control in response to the incorrect alignment detected on the components of the machine.

Document DE 43 35 479 proposes a method for detecting inclination based on the use of a measuring cell mounted on an excavation tool or digger. The inclination is measured continuously in the X and Y directions by the measuring cell. The information is stored and transferred wirelessly to a base station that relates the data item to the measured depth of the tool. The combined data are represented in a central data monitoring device and is submitted to an evaluation computer. The data item stored in the measuring cell is transferred to the base station when the cell passes through an absolute zero point.

Monitoring of the actual digging depth by the tool is a highly prized asset in the excavation field. Digging precision and rapidity can be achieved even in difficult visibility conditions. However, one drawback of these systems is pulling out of the cables connecting the sensors to the processing unit. After the breakage of a cable, the system is inoperative, since one is no longer collecting position signals from the sensor or sensors. It is therefore necessary with such systems to arrange for replacement cables and the operators have to waste time replacing the cables.

Strong protective sheathing can also be used to cover the cables or electrical connections, so as to limit instances of pulling out. Nevertheless, the use of strong protective sheathing (in stainless steel) does not prevent the pulling out of the cables in difficult digging conditions.

Another drawback of the existing systems is that it is necessary to spend at least a half day installing the set of sensors. In fact it is necessary, for example, to mount the sensor or sensors with screws, at a precise position on the arm (such as to a plate welded onto the arm for example). The protective sheathing, the electrical power cables of the sensors, and the communication cables for the position signals generated by the sensors, must also be suitably mounted. The installation of these cables (with or without sheathing) also wastes time. There is therefore a need for systems that are quicker to install and more robust in order to resist severe working conditions.

GENERAL DESCRIPTION OF THE INVENTION

The purpose of this present invention is therefore to overcome one or more of the drawbacks of the prior art by describing an angular position detecting device that is easy to install on an articulated component of a digging machine, while also being accurate, reliable and resistant to extreme working conditions.

This objective is met by means of an angular position detecting device to be fitted to an articulated component of a digging machine, which includes at least one attachment face equipped with attachment elements used to hold the attachment face flush against a flat moving surface of the machine, a module communicating by magnetic induction to send data to a receiver on a distant monitoring appliance, characterised in that the device accommodates, under at least one housing or envelope fixed to the attachment face:

an independent electrical power source, a processing unit, an electronic position-detecting module, and in that the electronic position-detecting module includes at least one angular position sensor to supply angular position data to the processing unit, in which the communication module includes a transmitter, with a wireless interface, connected to the processing unit to remotely transmit the angular position data to the monitoring appliance in a transmission signal.

Thus, with this type of detection device it is possible to eliminate the cables and to quickly equip a digging machine with a system to monitor the movements of the machine. The device can simply be mounted on and attached to its support. For example, the user is able to hold the independent device in one hand as it is mounted. In addition, the independent electrical power supply, which is rechargeable in situ, eliminates the handling operations and the time wasting that one has with passive accumulators only.

According to another particular feature, the attachment elements of the attachment face are removable attachment elements and have no screws so that they can be attached manually without the use of tools.

According to another particular feature, the attachment face is flattened and the attachment elements include at least one magnet.

Thus, by virtue of the attachment face, one can be assured that the detection device will be positioned rapidly and accurately in a plane perpendicular to the axes of articulation. The angular position data will therefore be all the more precise.

According to another particular feature, the transmitter, with a wireless interface, on the communication module transmits an identifier that is proper to the device, in the transmission signal.

Thus, the articulated component receiving the detector can be identified via the identifier supplied by the transmission signal. This identification can be automatic and can save valuable time for the operator. Naturally, other options for the identification of detectors can be employed. For example, the angular data can be sent in messages without identification, and a synchronisation process triggered by an equipment item in the control cabin is used in this case to acquire the identification data by considering the order of arrival.

According to another particular feature, the independent electrical power source includes at least one battery that is charged by photovoltaic cells.

According to another particular feature, the photovoltaic cells are mounted on at least one panel opposite to the attachment face.

Thus, the electrical power supply comes from a local power source (actually inside the detection device itself), by the conversion into electricity of available natural energy, namely light energy.

According to another particular feature, all of the components are mounted on the back of the attachment face, with the components and associated solar panels being covered by a transparent protective housing.

The use of solar panels, protected under the housing, allows one to dispense with wires and power cables, and the operator does not need to detach the device to recharge or change the battery. Furthermore, standard washing (typically at the same time as the washing of the digging machine) can be effected as appropriate when the housing of the detection device is very dirty.

According to another particular feature, each angular position sensor is of the accelerometric sensor type.

According to another particular feature, the attachment elements of the attachment face can include positioning cavities or notches.

Another aim of the invention is to provide a response to one or more of the problems encountered in the prior art by describing an installation system that is simple and reliable for determining the position of a bucket or digging tool at the end of the arm of a digging machine.

This aim is met by a system for determining the position of a tool mounted on an articulated arm of a digging machine, which includes a monitoring appliance and several position-detecting devices, where each of the detection devices includes:

- at least one attachment face equipped with attachment elements to be held flush against an articulated component of the digging machine,
- a communication module to remotely transmit data to a receiver on the monitoring appliance,
- an independent electrical power source,
- a processing unit, and
- an electronic position-detecting module, characterised in that in each of the detection devices of the said electronic position-detecting module includes at least one angular position sensor to supply angular position data to the processing unit, and the communication module includes a transmitter, with a wireless interface, connected to the said processing unit, to remotely transmit the angular position data to the monitoring appliance in a transmission signal, with the detection devices being distributed so that each is on a different articulated part of the digging machine, and with the monitoring appliance including:

- a wireless communication receiver to receive the transmission signal,
- a user interface equipped with a display screen, and
- a module to calculate the position of the tool by means of the angular position data emitted by all of the detection devices.

As can be appreciated by those practised in the art, the communication module and the processing unit can only be a single appliance.

According to another particular feature, the transmitter, with a wireless interface, on the communication module of each of the detection devices transmits an identifier in the transmission signal.

According to another particular feature, the independent electrical power source includes at least one battery that is charged by photovoltaic cells.

According to another particular feature, the attachment face is flattened and the attachment elements include at least one magnet.

According to another particular feature, the computing module also compares the position of the tool, calculated with a reference depth configured via the user interface, to determine a setpoint for vertical adjustment of the tool, with the computing module delivering a signal that is representative of the said setpoint intended for the display screen.

Another aim of the invention is to provide a response to one or more of the problems encountered in the prior art by describing an installation system that is simple and reliable for determining the position of a bucket or digging tool at the end of the arm of a digging machine.

To this end, the invention also proposes an excavation machine that includes a chassis, a support arm attached so that it pivots on the chassis, a bucket arm with a first end and a second end, with the first end being attached so that it pivots on the support arm, a tool of the bucket type attached so that it pivots on the second end of the bucket arm, and an actuator system that operates the support arm, the bucket arm and the tool, by means of control signals, characterised in that it includes the following:

- three angular position-detecting devices each equipped with a transmitter, with a wireless interface, and an independent electrical power source, with the said three devices being distributed on the support arm, the bucket arm and the tool respectively;
- a user interface to provide control of the actuator system; and
- in liaison with the user interface, a monitoring appliance equipped with a wireless communication receiver to receive emitted signals delivered by the transmitters of the three detection devices.

We thus obtain a digging machine without any cables and whose digging tool (or a similar tool) can be monitored with a continuous indication of its position, which, for example, can be its position in relation to the point of articulation of the arm support on the chassis of the machine. The risk of a break in the monitoring link due to pulling out of the cables (power supply and position indicating) is therefore eliminated. Transmission of the position data can be effected advantageously by radio messages. Three angles in relation to a given plane of reference are used to determine the vertical position of the tool. In fact, it suffices, for example, to be in possession of the following calculation parameters—the length of the support shaft, the length of the bucket shaft, and the length of the tool or bucket, the position of each detector on each of the respective machines and measured angular parameters (angles and/or angle variations).

According to another particular feature, the transmitter, with a wireless interface, on the communication module of each of the detection devices, transmits an identifier in the transmission signal, with the monitoring appliance including a correspondence table in order to associate, with an articulated component (from the support arm, the bucket arm and the tool), an angular position transmitted in the transmission signal, with this association being established by virtue of the detection device identifier transmitted with the angular position in the transmission signal.

According to another particular feature, the transmitters and the receiver employ radio waves at a given frequency.

According to another particular feature, the monitoring appliance includes:

a memory to store a reference depth parameter;

a module to calculate the setpoint for vertical movement of the tool by the use of angular position data supplied by the three detection devices and the reference depth parameter;

a link to a display screen on the user interface, to supply this display screen with the result of the setpoint calculation.

Thus, when a reference depth parameter is recorded, the monitoring appliance can advantageously be used to indicate on the screen whether it is necessary to hold, raise or lower the position of the bucket.

According to another particular feature, the support arm or the detection device placed on the support arm is equipped with a linear laser receiver device used to detect the passage of the linear laser receiver at a height that is defined by a reference laser plane, where the linear laser receiver device includes a wireless communication module to send laser beam detection data to the monitoring appliance in a transmission signal. This can, for example, allow determination of the angle of the support arm and calibration of the assembly.

According to another particular feature, the linear laser receiver device includes at least one linear reception cell with aligned photodiodes.

The invention, with its characteristics and advantages, will be understood more clearly on reading the description that follows with reference to the appended drawings, provided by way of examples only and not limited.

BRIEF DESCRIPTION OF THE DRAWINGS

FIG. 3 is an illustration of a system according to a preferred embodiment of the invention for determining a position, which uses the relationship between the angles detected and the vertical depth position of the bucket on the digging machine, FIGS. 4A and 4B respectively are views from above and below of a wireless angular position-detecting device according to a preferred embodiment of the invention.

DETAILED DESCRIPTION OF THE DRAWING

Figure 1:
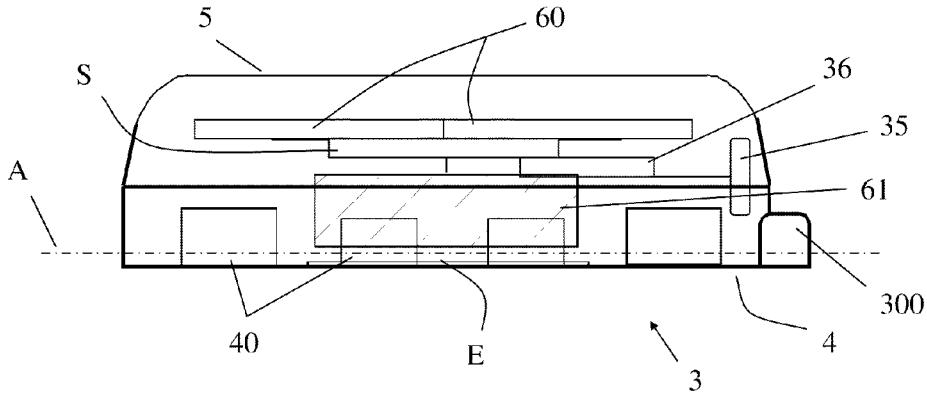
FIG. 1 is a cut-away side view of a wireless angular position-detecting device according to a preferred embodiment of the invention.
Figure 2:
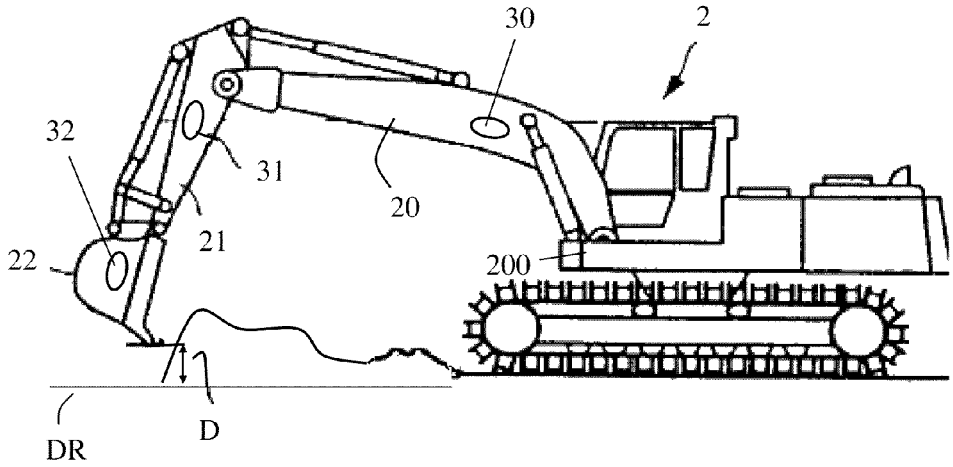
FIG. 2 is an illustration of a digging machine equipped with wireless detection devices, and capable of monitoring the position of the bucket according to the invention.

With reference to FIGS. 1 to 3, the system according to the invention is used to collect position data relating to the different articulated devices of a digging machine such as a mechanical digger. The system applies to excavation machines (2) and more generally to any machine that requires to monitor the depth of a working tool. In what follows, and in a manner that is not limiting, the description refers to an excavation machine (2).

This type of machine (2) typically includes a chassis (200), a support arm (20) attached so that it pivots on the chassis (200), a bucket arm (21) with a first end and a second end, with the first end being attached so that it pivots on the support arm (20), a tool of the bucket type (22) that is attached so that it pivots on the second end of the bucket arm (21), and an actuator system receiving control signals and used to operate the support arm (20), the bucket arm (21) and the tool (22). The control signals are originated via a user interface that is preferably located in a control cabin.

According to the invention, the position data are angular position data in relation to a given reference plane or direction (vertical for example). These angular position data can be generated by electronic modules with angular position sensors (S). In one embodiment, each sensor (S) determines its intrinsic angular position in relation to the vertical as illustrated in FIG. 4A. In order to dispense with cables, these angular position data are advantageously sent by the detection devices (30, 31, 32) by means of a transmitter, with a wireless interface, in a radio message, for example. A radio message that is broadcast omnidirectionally is preferable to an infrared (IR) message, which requires directional transmission of the information. The radio transmission is preferably effected during a short transmission time. The transmission times can be synchronised with each other for the different devices (30, 31, 32). This saves energy. The transmitters and the receiver make use of radio waves at a given frequency for example. Any other wireless communication, whether short or long distance, can be used.

The electrical power supply source (61) is an independent source in order to avoid the need for cables. In the independence of the source, it is necessary to include independence in relation to any sources of electrical power outside of the device (3). Recharging can thus be effected in situ. In the example of FIGS. 1 and 3, this is a battery that is charged by means of one or more solar panels (60). One or more batteries can be loaded into the device (3) and charged by photovoltaic cells. Such an energy source is renewable and does not require extraction of the battery for recharging. The photovoltaic cells are oriented opposite to the attachment face and can be located on a face of the housing (5) or just below the housing (5), which in this case must be transparent. A conventional auxiliary battery of low capacity can be provided in the device in order to replace the main battery for a short time as it is charged via the solar panels (60). In one embodiment of the invention, the angular position detecting device (3) is started automatically on exposure to the light by virtue of the solar panels (60). The latter are simply separated and protected from the exterior by at least one transparent housing (5) or envelope.

It can therefore be seen that the device (3) is independent and can be mounted initially on its support in a manner that is independent of all other equipment. In the example of FIGS. 1 and 3, the detection devices (30, 31, 32) are thus all interchangeable at the start, before the learning or configuration stage, which is used to specialise and identify the position of each of these devices (30, 31, 32) on the machine (2). In order to allow specialisation, the transmitter with the wireless interface on the communication module (35) can transmit a specific identifier that will be stored by the monitoring appliance (10). This identifier is transmitted in the transmission signal (Sg), such as a radio message for example. The monitoring appliance (10) can include a correspondence table to associate an angular position transmitted in the transmission signal (Sg) with one of the articulated devices on the mechanical digger. A synchronisation that is originated from the monitoring appliance (10) can also be used to examine the receive order of the signals, and thus to identify the origin of each of the transmission signals (Sg).

In the example of FIG. 1, the detection device (3) includes at least one attachment face (4) that is equipped with attachment elements (40, 41) on the components (20, 21, 22) of the excavation machine (2). These attachment elements (40, 41) are used to hold the attachment face (4) flush against the flat moving surface of each articulated component. As illustrated in FIGS. 1, 4A and 4B, the attachment elements (40, 41) of the attachment face (4) are elements allowing an attachment that is removable. The device (3) can easily be positioned, removed and repositioned, since it is simply attached to its support by magnets. Six magnets are illustrated on the device (3) of FIG. 4B. More generally, the attachment elements (40, 41) have no screws, so that they can be attached manually without the use of tools. Removal can be facilitated by the presence of one or more notches (E) on the side of the attachment face (4), at a lateral edge. A normal tool such as a screwdriver or other flat-ended object can be used in this case to move the attachment face (4) away from of the support, which is always metallic in the case of public works machines and of excavation machines (2) in particular. The attachment face (4) is preferably flattened and the attachment elements (40, 41) include at least one magnet (40). Using several magnets (40) prevents slippage of the device.

In the embodiment of FIG. 4B, cavities or notches (41) are provided on the side of the attachment face (4) in order to allow positioning of the detection device (2) in a favoured direction. Such positioning notches can be used (if necessary) in order to re-position the devices accurately on the arms of the mechanical digger. The latter can receive a welded plate equipped with centring pins. Two cavities at least, with different shapes or locations can thus be used on the side of the attachment face (4). No slippage or incorrect positioning of the device (3) is possible with this type of positioning.

In one preferred embodiment of the invention, the angular position detecting device (3) is compact and houses the main components under the housing (5) fixed to the attachment face (4). The independent electrical power supply source (61), the processing unit (36), and the electronic position-detecting module, are thus protected by the housing (5). As can be appreciated by those practised in the art, the electronic module can form a sensor circuit (S) into which the transducer elements sensitive to movement, and the processing unit (36), are incorporated. The transmitter, with a wireless interface, can be located partially or completely outside the housing (5). For questions of robustness, it is more advantageous to house all the components (35, S, 36, 60, 61) under the said housing (5). Access to certain of the components, in particular the battery and the electronic circuit forming the sensor (S), can be arranged from below, on the side of the attachment face (4). The housing (5) can be mounted removably on the support part that includes the attachment face (4).

Figure 5:
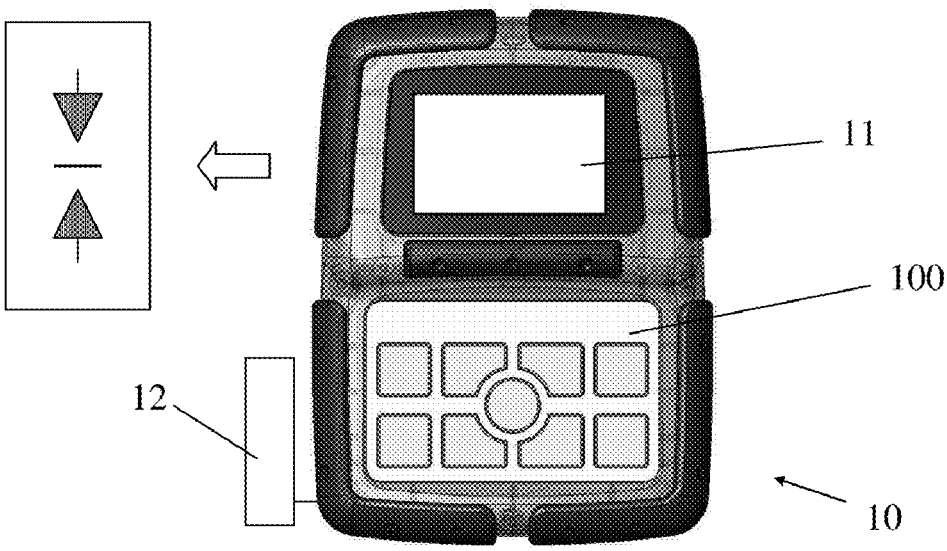
FIG. 5 is a view of the case of a monitoring appliance that can be used according to a preferred embodiment of the invention in combination with the wireless angular position-detecting devices, and FIGS. 6A and 6B respectively are illustrations of movements of the bucket alone and of the bucket arm alone, for allowing a monitoring appliance as illustrated in FIG. 5, during a learning stage, to attribute a position on the machine to a detection device according to a preferred embodiment of the invention.

With reference to FIGS. 1 and 5, the angular position data can be processed by a monitoring appliance (10) that provides the operator with visual indications that facilitate control of the working tool (generally a bucket). To this end, as illustrated in FIGS. 2 and 3, angular position-detecting devices (30, 31, 32) are placed respectively on the support arm (20), on the bucket arm (21) and on the bucket (22) of the machine. Each detection device (30, 31, 32) has a wireless communication module (35) to send the data wirelessly to a receiver on the monitoring appliance (10). This appliance (10) can be powered by the power supply present in the cabin of the excavation machine (2).

The mounting of each detection device (3) can be effected along a favoured direction of the articulated component acting as support for the device (3). The respective angles (A1, A2, A3) used to determine the depth reached by the bucket or tool (22) can thus be known to the extent that the angular position of each sensor (S) in relation to the arm/tool that supports it is a known parameter. The longitudinal axis (A) of the detection device (3) can be coincident with the favoured direction (length) of the support arm (20), of the bucket arm (21) or of the tool (22) for example. The angular position parameters for the attachment of each sensor (S) on its support are used by the monitoring appliance (10) for example.

The sensors (S) used are preferably incorporated into an electronic circuit. The electronic equipment for collecting the angular position detection data can be the Memsic MXD 20-20 modules, or modules from the ST, Analog Devices, or Motorola companies, for example. These modules are examples, and in no way limit the angular position-sensing equipment (S) capable of being mounted in a detection device (3) according to the invention. The modules with sensors (S) can consist of gyroscope-type electronic circuits, with a sensitivity that is capable of reaching 150 degrees/second for example (the detection principle is typically based on measurement of the Coriolis force produced during rotation of the support). Each angular position sensor (S) can be of the accelerometric sensor type. As can be appreciated by those practised in the art, any suitable equipment for measuring angular position can be mounted in a detection device (3) according to the invention.

The angular position sensor (S) mounted in the device (3) supplies angular position data to the processing unit (36). The communication module (35) immediately transfers these angular position data to the monitoring appliance (10), via a transmitter, with a wireless interface, connected to the processing unit (36). These angular position data are sent remotely in a transmission signal (Sg), preferably by radio. The monitoring appliance (10) then has all the parameters necessary for calculating the position of the tool (22) and the position data relating to the support arms (20), to the bucket arm (21) and to the tool (22). FIG. 3 illustrates the relationship between the angles (A1, A2, A3) in relation to the horizontal and the vertical depth position (D) of the tool (22) on the digging machine. The angles (A1, A2, A3) illustrated are deduced from the position data (in relation to the vertical for example) supplied by the sensor (S). The vertical distances (V1, V2, V3) associated with each of the articulated devices (20, 21, 22) on the machine (2) can be calculated as follows:

$V1=L_{BOOM}*\sin(A1)$; where $L_{BOOM}$ is the length of the support arm $V2=L_{Dipperstick}*\sin(A1)$; where $L_{Dipperstick}$ is the length of the bucket arm $V3=L_{BUCKET}*\mathrm{SIN}(A3)$; where $L_{BUCKET}$ is the length of the bucket The vertical distance (VC) relative to the chassis (200) can be allowed for. In the event of inclination of the chassis, an inclinometer/sensor similar or identical to the detection devices (30, 31, 32) can be used on the chassis to supply data that is representative of the angle of inclination (AC). The monitoring appliance (10) then arrives at a corrected distance (VC).

The vertical distance is the sum, V1+V2+V3+VC, of the vertical distances. The components of this sum are relative distances. In the example of FIG. 3, the distance V1 is thus negative. Once the desired depth (DR) has been configured, the monitoring appliance (10) can determine the difference of depth (D) of the tool (22) or bucket in relation to the reference depth (DR):

$$D=V-\mathrm{DR}$$

Naturally a horizontal distance (H) can be calculated in a similar manner by the monitoring appliance (10) that is in possession of the parameters and the angular position data.

In the example of FIGS. 2 and 3, we get a robust system for determining the position of the tool (22), by virtue of the monitoring appliance (10) collecting, remotely and wirelessly, the angular position data of the position-detecting devices (30, 31, 32), which are distributed so that each is on a different articulated part of the digging machine. Referring to FIGS. 3 and 5, the monitoring appliance (10) includes:

- a wireless communication receiver (12) to receive the transmission signals (Sg) sent by each of the independent devices (3),
- a user interface (100) equipped with a display screen, and
- a module for computing the position of the tool (22) by means of the angular position data emitted by all of the detection devices (30, 31, 32).

The computing module of the monitoring appliance (10) can compare the calculated position of the tool (22) (the distance V gives the actual depth reached by the tool (22)) with the reference depth DR configured via the user interface to determine a setpoint for vertical adjustment of the tool (22). The computing module thus delivers a signal that is representative of the said setpoint intended for the display screen. FIG. 5 illustrates adjustment icons (down arrow to lower the tool, horizontal line to hold the position, and up arrow to raise the tool). One of these icons is selected and displayed as a function of the calculated value (D) for example.

The monitoring appliance (10) includes a memory to store the reference depth parameter. The computing module is used, for example, to calculate a setpoint for vertical movement of the tool (22) by using angular position data supplied by the three detection devices (30, 31, 32) and the reference depth parameter (DR).

In the cabin, the monitoring appliance (10) can take the form of a compact case equipped with control keys and an LCD screen or similar, in particular facilitating the configuration operations (the functions capable of being displayed). A separate display unit monitor via the case can be provided to indicate the visual setpoint. In his or her normal field of vision, the user is able to monitor the indications relating to the movement of bucket to be effected in order to preserve the setpoint for the depth (DR). This cabin display unit can be accommodated in a case that incorporates the wireless communication interface. Reception as well as radio transmission is managed by this communication interface. The radio transmission coming from the cabin can be used in particular to synchronise the signals emitted by the devices (30, 31, 32), to provide an identifier, to ask for status information such as the battery charge level, and for maintenance (updating of on-board software, request for version, and similar monitoring operations).

In the embodiment of FIG. 3, this wireless communication interface is used to receive emitted radio signals (Sg') from a laser receiver. The support arm (20) can be equipped with a linear laser receiver device (70) used to detect a height from a reference laser plane. This linear laser receiver device (70) includes a wireless communication module to send the transmission signal or signals (Sg') and thus to transmit laser beam detection data to the monitoring appliance (10). The linear laser receiver device (70) can be independent in the same way as the angular position-detecting devices (30, 31, 32), and includes for example:

- at least one linear reception cell that includes aligned photodiodes (linear laser receiver),
- a power supply using solar panels that charge a battery,
- a radio transmitter provided in the wireless communication module to send the data by radio, and
- an attachment face with magnets.

The monitoring appliance (10) receives the data supplied by the device (70). These data are representative of the height detection from the reference laser plane (at the start and/or for correction of drift). The linearity of the receiver laser is used to capture the beam over a greater height, and so not to stop the movement of the support arm (20) for detection purposes. An intermediate photodiode can be considered for the reference sensor and the photodiodes placed higher and lower respectively in relation to this reference are each associated with an increment or a decrement in the height adjustment. Alternatively, a receiver (low cost and less accurate) can simply consist of a non-linear cell, possibly with a lens system to increase the detection area. Either of these options can be chosen to suit the circumstances.

One of the advantages of using a system for determining position by means of independent detection devices is the ability to rapidly equip an excavation machine (2) and to overcome problems of cable robustness. Detection of the angular position of the mechanical digger arm (or bucket) on which the device is placed can thus be effected rapidly after fitting the devices (3) by their attachment face (4) with magnets (40). Appropriate calculation methods can be used so that once the detection devices (3, 30, 31, 32) have been positioned, the monitoring appliance (10) is able to determine, with precision, the angles necessary for the calculation of depth (D).

A considerable amount of time can be saved, firstly by mounting the devices (30, 31, 32) with no wire or screw connections, and secondly by eliminating of delicate measurements or manoeuvres for installing and configuring the position determining system. The articulated devices (20, 21, 22) can include indicating patterns to form a location in which to mount the detection device (3), on a longitudinal axis of the machine for example. The shape of the devices (3, 30, 31, 32) can be elongated and/or can have a projecting shape (300) to indicate a longitudinal direction of the device (3). The user can thus place the projecting shape in the direction of the length of the articulated component (20, 21, 22) used as the support. The monitoring appliance (10) can thus rapidly estimate the configuration and the accurate positioning of the different detection devices (30, 31, 32). In one embodiment, the computing module can also effect an angular correction to allow for the positioning differences in relation to a reference position on the support. For the angular correction, the operator simply has to successively move one of the articulated devices (20, 21, 22), and to effect a calculation based on the angle changes which allows determination of the correction to be made in relation to a reference position on the support carrying the detection device (3, 30, 31, 32).

Figure 6A:
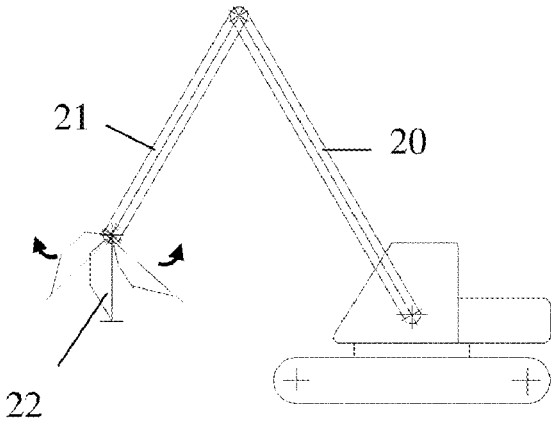
Figure 6B:
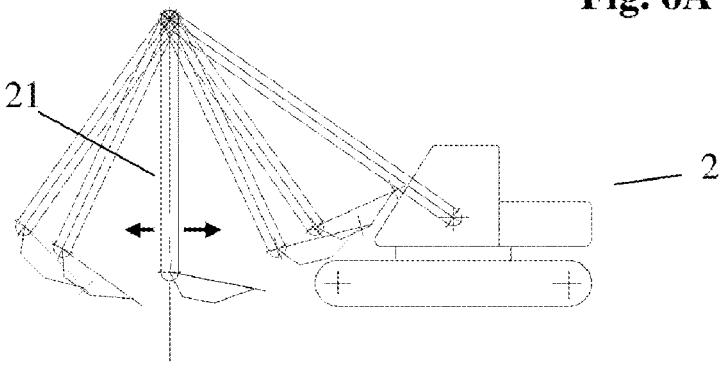

According to one option, the identification on the mechanical digger of each of the devices (30, 31, 32) can be achieved by controlling the movements of one articulated component. The detection devices (30, 31, 32) are placed without identification on the respective articulated devices (20, 21, 22) of the mechanical digger (exposes to the light, their radio standby system is activated). After mounting the devices (30, 31, 32), a learning phase can begin. For this, the operator prepares the monitoring appliance (10) for identification. On the display unit or screen (11) of the monitoring appliance (10), the operator is provided with a setpoint in order to control a movement of each element (20, 21, 22) on its own. This type of movement is illustrated in FIG. 6A (movement of the bucket only) and FIG. 6B (movement of the bucket arm (21) only). Thus, the device (30, 31, 32) whose sensor (S) undergoes and detects a movement (greater than the vibration of the machine) is considered to be that supported by the element (20, 21, 22) that the operator has moved. With this type of learning, each identifier sent in the transmission signal (Sg) is associated specifically with a unique articulated component (20, 21, 22).

Another method for identifying the location of the angular position-detecting devices (30, 31, 32) can be executed during removal from its packaging for example.

The detection devices (30, 31, 32) are stored flat and insulated from the light by the packaging. During opening of the packaging, the detection devices (30, 31, 32) receive energy by the arrival of light, and therefore start up their radio system. The user (following an instructions manual for example) can prepare the monitoring appliance (10) for the identification of each detection device (30, 31, 32), one by one, via the user interface (100). The user thus extracts each of the sensor (S) devices (31, 32, 33) and places the device on the bench (the accelerometer sensor (S) thus moved therefore indicates an angular position which is it unable to display when flat). The detection device can therefore be identified and an identifier associated with this detection device can be created and/or stored in the monitoring appliance. For example, the device is associated at this stage with one of the articulated devices (20, 21, 22) of the excavation machine (2). The user can place a marker (a label or similar) to identify the sensor device (30, 31, 32) which is thus specialised. It then only remains to place each angular position detecting device (30, 31, 32) on its corresponding support on the mechanical digger (typically on a support arm, bucket arm, bucket, etc.). A software safety arrangement is provided in the monitoring appliance (10), to detect any possible mounting errors for example.

It must be obvious to those familiar with the subject that this present invention allows embodiments in many other specific forms without moving away from the field of application of the invention as claimed. In particular, there is nothing to prevent the use of a system for determining the position of a tool in the case of a machine with an arm with more than the three elements mentioned above (arm, bucket carrying arm and bucket). The calculation principle remains the same. There is just one more sensor device (3).

The invention claimed is:

1. An angular position detecting device to be fitted to an articulated component of a digging machine having at least one attachment face equipped with attachment elements for holding the attachment face flush against a flat moving surface of a machine element, and a communication module for wirelessly sending data to a receiver on a distant monitoring appliance, the device being arranged for accommodating the following under at least one housing or envelope fixed to the attachment face:

an independent electrical power supply source, a processing unit, an electronic position-detecting module, the electronic position-detecting module including at least one angular position sensor for supplying angular position data to the processing unit, the communication module including a transmitter having a wireless interface connected to the processing unit for remotely transmitting the angular position data to the monitoring appliance as a transmission signal;

the attachment elements of the attachment face being removable attachment elements including at least one magnet, and having no screws so that the removable attachment elements can be attached manually without the use of tools.

2. A device according to claim 1, wherein the attachment face is flat.

3. A device according to claim 1, wherein the transmitter with the wireless interface on the communication module is arranged for including an identifier for the angular positioning detecting device in the transmission signal.

4. A device according claim 1, further including an independent electrical power supply source for supplying power to the electronic position-detecting module, the electric power source including at least one battery that is adapted to be charged by at least one photovoltaic cell.

5. A device according to claim 4, wherein the at least one photovoltaic cell is mounted on at least one solar panel opposite to the attachment face.

6. A device according to claim 5, wherein all the components are mounted on the back of the attachment face, the components and associated solar panels being covered by a transparent protective housing.

7. A device according to claim 1, wherein each angular position sensor includes an accelerometer sensor.

8. A device according to claim 1, wherein the attachment elements of the attachment face include cavities or notches for positioning the attachment face along a favored direction.

9. An angular position-detecting device in a system for determining the position of a tool mounted on an articulated arm of a digging machine having a monitoring appliance; each of the detection devices including:

at least one attachment face equipped with removable attachment elements including at least one magnet, to be held flush against an articulated component of the digging machine without the need to use screws, a communication module for remotely transmitting data to a receiver on the monitoring appliance, an independent electrical power supply source, a processing unit, and an electronic position-detecting module, each of the electronic position-detecting modules including at least one angular position sensor for supplying angular position data to the processing unit, the communication module including a transmitter having a wireless interface connected to the processing unit for remotely transmitting the angular position data to the monitoring appliance in a transmission signal, the detection devices being distributed so each of the detection devices is on different articulated parts of the digging machine, and the monitoring appliance includes:

a wireless communication receiver for receiving the transmission signal, a user interface having a display screen, and a module for calculating the position of the tool in response to the angular position data emitted by all the detection devices.

10. The detection device according to claim 9, wherein the transmitter with the wireless interface on the communication module of each of the detection devices is arranged for transmitting an identifier in the transmission signal.

11. The detection device according to claim 9, wherein the independent electrical power source includes at least one battery that is adapted to be charged by at least one photovoltaic cell.

12. The detection device according to claim 9, wherein the attachment face is flat.

13. The detection device according to claim 9, wherein the computing module is arranged to compare the calculated position of the tool with a reference depth arranged to be derived via the user interface, the computing module being arranged to respond to an indication of the comparison by (a) determining a set point for vertical adjustment of the tool, (b) a signal that is representative of the set point, and (c) supplying the set point representing signal to the display screen.

14. A system for determining the position of a tool of an excavation machine having a chassis, a support arm pivotally attached to the chassis, a bucket arm having first and second ends, the first end being pivotally attached on the support arm, a bucket pivotally attached to the second end of the bucket arm, an actuator system for operating (a) the support arm, (b) the bucket arm and (c) the tool in response to control signals;

three angular position-detecting devices, each including a transmitter with a wireless interface and an independent electrical power source, the three angular position-detecting devices being respectively positioned by magnets on the support arm, the bucket arm and the tool;

a user interface for controlling the actuator system; and a monitoring appliance adapted to operate in liaison with the user interface, the monitoring appliance including a wireless communication receiver for receiving signals adapted to be delivered by the transmitters of the three detection devices.

15. The system for determining the position of a tool on a machine according to claim 14, wherein the transmitter has a wireless interface on the communication module of each of the detection devices and is arranged to include an identifier in the transmission signal, the monitoring appliance including a correspondence table for associating an angular position, included in the transmission signal, with an articulated component selected from (a) the support arm, (b) the bucket arm and (c) the tool, this association being arranged to be established in response to the detection device detecting the identifier transmitted with the angular position in the transmission signal.

16. The system for determining the position of a tool on a machine according to claim 14, wherein the transmitters and the receiver are arranged to employ radio waves at a given frequency.

17. The system for determining the position of a tool of a machine according to claim 14, wherein the monitoring appliance includes:

a memory for storing a reference depth parameter;

a module for calculating the set point for vertical movement of the tool in response to angular position data supplied by the three detection devices, and of the reference depth parameter;

a link to a display screen on the user interface for supplying the display screen with the result of the set point calculation.

18. The system for determining the position of a tool on a machine according to claim 14, wherein the support arm or the detection device on the support arm includes a linear laser receiver device for detecting the passage of the linear laser receiver at a height that is defined by a reference laser plane, the linear laser receiver device including a wireless communication module for sending laser beam detection data in a transmission signal to the monitoring appliance.

19. The system for determining the position of a tool on a machine according to claim 18, wherein the linear laser receiver device includes at least one linear reception cell having aligned photodiodes.

* * * * *